US008592356B2

(12) United States Patent
Ito

(10) Patent No.: US 8,592,356 B2
(45) Date of Patent: Nov. 26, 2013

(54) LUBRICANT COMPOSITION FOR INTERNAL COMBUSTION ENGINE

(75) Inventor: Koki Ito, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 107 days.

(21) Appl. No.: 12/602,130

(22) PCT Filed: May 21, 2008

(86) PCT No.: PCT/JP2008/059312

§ 371 (c)(1),
(2), (4) Date: Nov. 27, 2009

(87) PCT Pub. No.: WO2008/146669

PCT Pub. Date: Dec. 4, 2008

(65) Prior Publication Data

US 2010/0144567 A1 Jun. 10, 2010

(30) Foreign Application Priority Data

May 29, 2007 (JP) ..... 2007-142167

(51) Int. Cl.
*C10M 135/26* (2006.01)
*C10M 139/00* (2006.01)
*C10M 133/12* (2006.01)

(52) U.S. Cl.
USPC ..... 508/465; 508/189; 508/192; 508/194; 508/287; 508/551; 508/563

(58) Field of Classification Search
USPC ..... 508/192, 189, 194, 509, 465, 506, 287, 508/551, 563
See application file for complete search history.

(56) References Cited

U.S. PATENT DOCUMENTS

| | | | | |
|---|---|---|---|---|
| 2,691,000 | A | 10/1954 | Elliott | |
| 3,518,193 | A | 6/1970 | Cyba | |
| 4,198,305 | A | 4/1980 | Okorodudu | |
| 4,239,636 | A | 12/1980 | Brois et al. | |
| 4,370,246 | A | 1/1983 | DeVries et al. | |
| 4,417,062 | A | 11/1983 | Brois et al. | |
| 4,568,756 | A | 2/1986 | Brois et al. | |
| 4,866,187 | A | 9/1989 | Brois et al. | |
| 4,965,375 | A | 10/1990 | Brois et al. | |
| 5,141,658 | A | 8/1992 | DiBiase | |
| 5,530,163 | A | 6/1996 | Shaw | |
| 5,965,495 | A * | 10/1999 | Goto et al. | 508/192 |
| 6,063,741 | A | 5/2000 | Naitoh et al. | |
| 7,309,680 | B2 | 12/2007 | John et al. | |
| 2003/0182847 | A1 | 10/2003 | Katafuchi | |
| 2004/0192562 | A1 | 9/2004 | Morita | |
| 2005/0034358 | A1 | 2/2005 | Katafuchi | |
| 2006/0148663 | A1 | 7/2006 | Shimizu | |
| 2007/0049506 | A1 | 3/2007 | Katafuchi et al. | |
| 2007/0142238 | A1 | 6/2007 | Katafuchi | |
| 2008/0045424 | A1 | 2/2008 | Shimizu et al. | |
| 2009/0203561 | A1 | 8/2009 | Kamano | |
| 2009/0292137 | A1 | 11/2009 | Shimizu et al. | |
| 2010/0009882 | A1 | 1/2010 | Ito | |

FOREIGN PATENT DOCUMENTS

| | | | |
|---|---|---|---|
| EP | 0 699 739 | A2 | 3/1996 |
| EP | 0 822 246 | A2 | 2/1998 |
| EP | 1 136 497 | A1 | 9/2001 |
| EP | 1 338 641 | A1 | 8/2003 |
| EP | 1 371 716 | A1 | 12/2003 |
| EP | 1 602 709 | A1 | 12/2005 |
| EP | 1 734 104 | A1 | 12/2006 |
| EP | 1 760 136 | A1 | 3/2007 |
| EP | 1 785 469 | A1 | 5/2007 |
| EP | 2 077 319 | | 7/2009 |
| GB | 659751 | | 10/1951 |
| GB | 1145189 | | 3/1969 |
| JP | 55-57557 | | 4/1980 |
| JP | 59-10559 | | 1/1984 |
| JP | 3-22438 | | 3/1991 |
| JP | 7-206810 | | 8/1995 |
| JP | 8-73878 | | 3/1996 |
| JP | 10-46177 | | 2/1998 |
| JP | 2001-262175 | | 9/2001 |
| JP | 2001-288490 | | 10/2001 |
| JP | 2002-294271 | | 10/2002 |

(Continued)

OTHER PUBLICATIONS

Toshio Sakurai, "Petroleum Product Additives", Saiwal Shabo, Aug. 10, 1974, pp. 192-196 and 202 (with English Translation).
E.S. Forbes, et al., "The Load-Carrying Properties of Diester Disulphides", Wear, vol. 15, 1970, pp. 341-352.
R.M. Matveevsky, et al., "Khimiya I Tekhnologiya Topliv I Masel" (translated as "Tribological Study of Oxygen-Containing Sulfide and Disulfide"), 1984, pp. 26-28 (with English Translation).
Office Action issued Dec. 29, 2011 in Russia Application No. 2009148756/04 (With English Translation).

(Continued)

*Primary Examiner* — Ellen McAvoy
*Assistant Examiner* — Vishal Vasisth
(74) *Attorney, Agent, or Firm* — Oblon, Spivak, McClelland, Maier & Neustadt, L.L.P.

(57) ABSTRACT

A lubricating oil composition used in an internal combustion engine contains lubricating base oil; a disulfide compound as a component (A), a no-boron-containing ashless dispersant as a component (B), and a boron-containing ashless dispersant as a component (C). The disulfide compound as the component (A) is represented by the following formula (1) and/or the following formula (2). The no-boron-containing ashless dispersant as the component (B) has in its side chain: an alkyl group having a number average molecular weight of 500 to 3,000; or an alkenyl group having a number average molecular weight of 500 to 3,000. The boron-containing ashless dispersant as the component (C) has in its side chain: an alkyl group having a number average molecular weight of 500 to 4,000; or an alkenyl group having a number average molecular weight of 500 to 4,000.

$$R^1OOC\text{-}A^1\text{-}S\text{—}S\text{-}A^2\text{-}COOR^2 \quad (1)$$

$$R^7OOC\text{—}CR^9R^{10}\text{—}CR^{11}(COOR^8)\text{—}S\text{—}S\text{—}CR^{16}(COOR^{13})\text{—}CR^{14}R^{15}\text{—}COOR^{12} \quad (2)$$

19 Claims, No Drawings

(56) References Cited

FOREIGN PATENT DOCUMENTS

| | | | |
|---|---|---|---|
| JP | 2003-500521 | | 1/2003 |
| JP | 2003-523454 | | 8/2003 |
| JP | 2003-252887 | | 9/2003 |
| JP | 2003-336089 | | 11/2003 |
| JP | 2004-2866 | | 1/2004 |
| JP | 2004-51985 | | 2/2004 |
| JP | 2004 262964 | | 9/2004 |
| JP | 2004 262965 | | 9/2004 |
| JP | 2005-146010 | | 6/2005 |
| JP | 2005 281614 | | 10/2005 |
| JP | 2005 290158 | | 10/2005 |
| JP | 2006 45336 | | 2/2006 |
| JP | 2006045335 | * | 2/2006 |
| JP | 2007-63431 | | 3/2007 |
| RU | 2029778 | | 8/1995 |
| TW | 200508384 | | 8/2004 |
| WO | WO 00/71649 | A1 | 11/2000 |
| WO | WO 01/60956 | A1 | 8/2001 |
| WO | WO 02/16532 | A1 | 2/2002 |
| WO | 2004 069966 | | 8/2004 |
| WO | 2006 013946 | | 2/2006 |

OTHER PUBLICATIONS

Notice of Allowance in corresponding Russian Patent Application No. 2009148756 dated Jul. 20, 2012.

Notice of Allowance in the corresponding Russian Patent Application No. 2009148756 dated Jul. 20, 2012 w/English Translation.

Search Report as received in the corresponding European Patent Application No. 08764435.7 dated Sep. 25, 2013.

Office Action as received in the corresponding Taiwanese Patent Application No. 97119727 dated Sep. 11, 2013 w/English Translation.

* cited by examiner

LUBRICANT COMPOSITION FOR INTERNAL COMBUSTION ENGINE

This application is a 371 of PCT/JP08/59312, filed May 21, 2008.

CROSS REFERENCE TO RELATED APPLICATIONS

The present application is the national stage of international application PCT/JP2008/059312, filed on May 21, 2008, and claims the benefit of the filing date of Japanese Application No. 2007-142167, filed on May 29, 2007.

TECHNICAL FIELD

The present invention relates to a lubricating oil composition used in an internal combustion engine such as a diesel engine or a gasoline engine.

BACKGROUND ART

These days, environmental regulations are being increasingly tightened on a global scale, among which fuel efficiency regulations and exhaust emission regulations for automobiles are especially being further tightened.

An important problem especially in a diesel engine has been how to reduce environment pollution caused by emission gas components such as particulate matters (PM) such as soot and $NO_x$. An effective solution is to mount an exhaust purifying device such as a diesel particulate filter (DPF) or an exhaust purifying catalyst (oxidization or reduction catalyst) on an automobile.

On the other hand, lubricating oil used in an internal combustion engine is generally added with a metal-base detergent. Accordingly, when lubricating oil added with a metal-base detergent is used in an engine of an automobile on which a DPF as an exhaust purifying device is mounted, PM adhered to the DFR can be eliminated by oxidation or combustion. However, the DPF may be clogged by a metal oxide, a phosphoric salt and the like that are generated by combustion. Thus, reduction of such a metal-base detergent is demanded.

One effective solution for reducing fuel consumption of an automobile is to improve the automobile itself, for instance, by reducing size and weight of the automobile or by improving the engine. Another effective solution is to lower viscosity of lubricating oil so as to prevent friction loss of the engine. However, on the other hand, the lowering of the viscosity may cause portions of the engine to be more easily worn. In view of the above, a variety of additives are added to lubricating oil so as to prevent friction damages and wear of the engine entailed by lowered viscosity of the lubricating oil, among which ZnDTP (zinc dialkyldithiophosphate) is particularly known as an effective additive. ZnDTP, which is excellent in extreme-pressure properties and wear resistance, is widely used in lubricating oil for an internal combustion engine.

However, although exhibiting excellent performance on one hand, ZnDTP itself degrades to generate an acid material such as sulfuric acid or phosphoric acid, so that such an acid material reacts with a base component contained in the lubricating oil, thereby causing a decrease in base number thereof and shortening the life of the lubricating oil on the other hand. Further, while a three-way catalyst is used as the exhaust purifying catalyst for gasoline automobiles, the three-way catalyst is poisoned by phosphorous components contained in the lubricating oil. Thus, reduction of an additive containing phosphorus (e.g., ZnDTP) has been demanded.

With the above-described background, there has been a demand for lubricating oil containing neither metal-base detergent nor ZnDTP for use in an internal combustion engine, especially in a diesel engine.

However, drastic reduction of metal-base detergent has been difficult in view of long-drain capability, which is one of fundamental performances of the lubricating oil for internal combustion engines. Drastic reduction of ZnDTP has also been difficult in view of deterioration in wear resistance of engine valve portions. Lubricating oil using a specific disulfide compound as an antiwear agent has been also proposed (e.g., Patent Documents 1 to 3).

Patent Document 1: JP-A-2004-262964
Patent Document 2: JP-A-2004-262965
Patent Document 3: JP-A-2006-045336

DISCLOSURE OF THE INVENTION

Problems to be Solved by the Invention

However, it has been difficult to obtain lubricating oil that is entirely free from addition of metal-base detergent. Specifically, sufficient cleaning or dispersing effects on the inside of the engine cannot necessarily be obtained only by a use of an ashless dispersant. In addition, it has been not necessarily easy either to avoid using a metal-base detergent or ZnDTP in the lubricating oil compositions disclosed in Patent Documents 1 to 3 above when the compositions are applied as the lubricating oil for internal combustion engines.

An object of the present invention is to provide a lubricating oil composition used in an internal combustion engine, the lubricating oil composition providing sufficient cleaning or dispersing effects (long-drain capabilities) for a long time and excellent wear resistance.

Means for Solving the Problems

In order to solve the above-mentioned problems, according to an aspect of the present invention, lubricating oil compositions for internal combustion engines as follows are provided:

[1] a lubricating oil composition for an internal combustion engine, containing lubricating base oil; (A) a disulfide compound represented by a formula (1) as follows and/or a formula (2) as follows; (B) a no-boron-containing ashless dispersant having in its side chain an alkyl group having a number average molecular weight of 500 to 3000 or an alkenyl group having a number average molecular weight of 500 to 3000; and (C) a boron-containing ashless dispersant having in its side chain an alkyl group having a number average molecular weight of 500 to 4000; or an alkenyl group having a number average molecular weight of 500 to 4000.

$$R^1OOC\text{-}A^1\text{-}S\text{—}S\text{-}A^2\text{-}COOR^2 \quad (1)$$

In the formula, $R^1$ and $R^2$ each represent a hydrocarbyl group having 1 to 30 carbon atoms. The hydrocarbyl group may contain an oxygen atom, a sulfur atom or a nitrogen atom. $A^1$ and $A^2$ each represent a group represented by $CR^3R^4$ or a group presented by $CR^3R^4$—$CR^5R^6$. $R^3$ to $R^6$ each represent a hydrogen atom or a hydrocarbyl group having 1 to 20 carbon atoms.

$$R^7OOC\text{—}CR^9R^{10}\text{—}CR^{11}(COOR^8)\text{—}S\text{—}S\text{—}CR^{16}(COOR^{13})\text{—}CR^{14}R^{15}\text{—}COOR^{12} \quad (2)$$

In the formula, $R^7$, $R^8$, $R^{12}$ and $R^{13}$ each represent a hydrocarbyl group having 1 to 30 carbon atoms. The hydrocarbyl group may contain an oxygen atom, a sulfur atom or a nitrogen atom. $R^9$ to $R^{11}$ and $R^{14}$ to $R^{16}$ each represent a hydrogen atom or a hydrocarbyl group having 1 to 5 carbon atoms;

[2] the above-described lubricating oil composition, in which substantially no metal-base detergent is contained;

[3] the above-described lubricating oil composition, in which a content of the disulfide compound as the component (A) is 0.01 to 0.5 mass % in terms of sulfur of the total amount of the lubricating oil composition;

[4] the above-described lubricating oil composition, in which the component (B) is at least one of alkyl succinimide, alkenyl succinimide, aliphatic amide, alkyl benzyl amine and alkenyl benzyl amine, and a nitrogen content derived from the component (B) is 50 to 4000 ppm by mass of the total amount of the lubricating oil composition; and

[5] the above-described lubricating oil composition, in which the component (C) is a product formed by boron-modifying at least one of alkyl succinimide, alkenyl succinimide, aliphatic amide, alkyl benzyl amine and alkenyl benzyl amine, and a boron content derived from the component (C) is 50 to 3000 ppm by mass of the total amount of the lubricating oil composition.

According to the aspect of the present invention, by using both the disulfide compound having the specific structure and the two types of the ashless dispersants, the lubricating oil composition for an internal combustion engine, which exhibits excellent long-drain capabilities and wear resistance, can be provided. In other words, without being added with a metal-base detergent or ZnDTP, the lubricating oil composition for an internal combustion engine according to the present invention can provide practically sufficient effects.

BEST MODE FOR CARRYING OUT THE INVENTION

A lubricating oil composition for an internal combustion engine according to the present invention (hereinafter simply called as the "present composition") contains: lubricating base oil (hereinafter simply called as the "base oil"); (A) a disulfide compound; (B) a no-boron-containing ashless dispersant; and (C) a boron-containing ashless dispersant.

The base oil of the present composition is not particularly limited but may be suitably selected from any mineral oil and synthetic oil that have been conventionally used as base oil of the lubricating oil for an internal combustion engine. Examples of the mineral oil are mineral oil refined by processing lubricating oil fractions by at least one of solvent-deasphalting, solvent-extracting, hydrocracking, solvent-dewaxing, catalytic-dewaxing, hydrorefining and the like (the lubricating oil fractions are obtained by vacuum-distilling atmospheric residual oil obtained by atmospherically distilling crude oil) and mineral oil manufactured by isomerizing wax and GTL WAX.

On the other hand, examples of the synthetic oil are polybutene, polyolefin (α-olefin homopolymer or copolymer such as ethylene-α-olefin copolymer), various esters (such as polyol ester, diacid ester and phosphoric ester), various ethers (such as polyphenylether), polyglycol, alkylbenzene, alkyl naphthalene and the like. Among the above, polyolefin and polyol ester are particularly preferable in view of enhancement of oxidation stability.

In the present invention, one of the above mineral oil may be singularly used or a combination of two or more thereof may be used as the base oil. In addition, one of the above synthetic oil may be singularly used or a combination of two or more thereof may be used. Further, a combination of the above mineral oil and the above synthetic oil may be used.

Although viscosity of the base oil is subject to no specific limitation and the viscosity varies depending on usage of the lubricating oil composition, kinematic viscosity of base oil at 100 degrees C. is 2 to 30 $mm^2/s$, preferably 3 to 15 $mm^2/s$, more preferably 4 to 10 $mm^2/s$. When the kinematic viscosity at 100 degrees C. is 2 $mm^2/s$ or more, evaporation loss is small. When the kinematic viscosity at 100 degrees C. is 30 $mm^2/s$ or less, power loss due to viscosity resistance is not so large, thereby improving fuel efficiency.

As the base oil, oil whose % CA measured by a ring analysis is 3 or less and whose sulfur content is 50 ppm by mass or less can be preferably used. The % CA measured by the ring analysis means a proportion (percentage) of aromatic content calculated by the n-d-M method (a ring analysis). The sulfur content is measured based on Japanese Industrial Standard (hereinafter called as JIS) K 2541.

The base oil whose % CA is 3 or less and whose sulfur content is 50 ppm by mass or less exhibits a favorable oxidation stability. Such base oil can restrict an increase of acid number and a generation of sludge, thereby providing a lubricating oil composition that is less corrosive to metal.

The % CA is more preferably 1 or less, much more preferably 0.5 or less while the sulfur content is more preferably 30 ppm by mass or less.

In addition, viscosity index of the base oil is preferably 70 or more, more preferably 100 or more, much more preferably 120 or more. In the base oil whose viscosity index is 70 or more, a viscosity change due to a temperature change is small.

In order to obtain favorable long-drain capabilities and wear resistance, the present composition is added with (A) a disulfide compound having a specific structure, (B) a no-boron-containing ashless dispersant and (C) a boron-containing ashless dispersant. The above additives will be described below.

Component (A)

The component (A) is a disulfide compound represented by the following formula (1) and/or by the following formula (2).

$$R^1OOC\text{-}A^1\text{-}S\text{—}S\text{-}A^2\text{-}COOR^2 \quad (1)$$

$$R^7OOC\text{—}CR^9R^{10}\text{—}CR^{11}(COOR^8)\text{—}S\text{—}S\text{—}CR^{16}(COOR^{13})\text{—}CR^{14}R^{15}\text{—}COOR^{12} \quad (2)$$

In the formula (1), $R^1$ and $R^2$ each represent a hydrocarbyl group having 1 to 30 carbon atoms, preferably a hydrocarbyl group having 1 to 20 carbon atoms, more preferably a hydrocarbyl group having 2 to 18 carbon atoms, particularly preferably a hydrocarbyl group having 3 to 18 carbon atoms. When the hydrocarbyl group has the carbon atoms in the above range, the hydrocarbyl group is excellent in a balance between vaporizability, extreme-pressure properties and wear resistance. The hydrocarbyl group may be linear, branched or cyclic, and may contain an oxygen atom, a sulfur atom or a nitrogen atom. While $R^1$ and $R^2$ in the above formula may be mutually the same or different, $R^1$ and $R^2$ are preferably the same for manufacturing reasons.

$A^1$ and $A^2$ each represent a group represented by $CR^3R^4$ or a group represented by $CR^3R^4$—$CR^5R^6$. $R^3$ to $R^6$ each represent a hydrogen atom or a hydrocarbyl group having 1 to 20 carbon atoms. The hydrocarbyl group preferably has 1 to 12 carbon atoms, more preferably 1 to 8 carbon atoms. When the hydrocarbyl group has the carbon atoms in the above range, the hydrocarbyl group is excellent in a balance between vaporizability, extreme-pressure properties and wear resistance. In addition, while $A^1$ and $A^2$ may be mutually the same or different, $A^1$ and $A^2$ are preferably the same in order to obtain a single product when $A^1$ and $A^2$ are manufactured by the later-described oxidative coupling reaction.

The disulfide compound represented by the formula (1) can be exemplarily manufactured by the following method. Specifically, a material of mercapto alkane carboxylic acid ester represented by the following formula (3) and/or by the following formula (4) experiences an oxidative-coupling.

$$R^1OOC\text{-}A^1\text{-}SH \quad (3)$$

$$R^2OOC\text{-}A^2\text{-}SH \quad (4)$$

In the formulae, $R^1$, $R^2$, $A^1$ and $A^2$ are the same as described above.

According to such a manufacturing method, a polysulfide compound having more sulfur atoms than trisulfide is less likely to be subgenerated. Since a polysulfide compound in which three or more sulfur atoms (S) are chained corrodes non-ferrous metals, the manufacturing method and manufacturing conditions of the disulfide compound are preferably determined so that such a polysulfide compound is contained with a content of not more than 30 mass % of the summed amount of the disulfide compound and the polysulfide compound. As long as the content of the polysulfide is 30 mass % or less, corrosion of non-ferrous metals by the polysulfide can be sufficiently prevented even if such a polysulfide compound is mixed in the lubricating oil composition. The content of a polysulfide compound having three or more sulfur atoms (S) is more preferably 10 mass % or less, particularly preferably 5 mass % or less.

Examples of the product generated by the coupling reaction are compounds as follows:

$$R^1OOC\text{-}A^1\text{-}S\text{—}S\text{-}A^2\text{-}COOR^2;$$

$$R^1OOC\text{-}A^1\text{-}S\text{—}S\text{-}A^1\text{-}COOR^1; \text{ and}$$

$$R^2OOC\text{-}A^2\text{-}S\text{—}S\text{-}A^2\text{-}COOR^2.$$

An oxidant used in manufacturing disulfide by oxidizing α-mercapto carboxylic acid ester may be an oxidant used in manufacturing disulfide from mercaptan. Examples of the oxidant are oxygen, hydrogen peroxide, halogen (iodine, bromine), hypohalous acid (salt), sulfoxide (dimethyl sulfoxide, diisopropyl sulfoxide), manganese oxide (IV) and the like. Among the above oxidants, oxygen, hydrogen peroxide and dimethyl sulfoxide are preferable not only because the oxidants are less costly but also because the oxidants each facilitate the manufacturing of disulfide.

On the other hand, in the formula (2), $R^7$, $R^8$, $R^{12}$ and $R^{13}$ each represent a hydrocarbyl group having 1 to 30 carbon atoms, preferably a hydrocarbyl group having 1 to 20 carbon atoms, more preferably a hydrocarbyl group having 2 to 18 carbon atoms, particularly preferably a hydrocarbyl group having 3 to 18 carbon atoms. When the hydrocarbyl group has the carbon atoms in the above range, the hydrocarbyl group is excellent in a balance between vaporizability, extreme-pressure properties and wear resistance. The hydrocarbyl group may be linear, branched or cyclic, and may contain an oxygen atom, a sulfur atom or a nitrogen atom. While $R^7$, $R^8$, $R^{12}$ and $R^{13}$ in the above formula may be mutually the same or different, $R^7$, $R^8$, $R^{12}$ and $R^{13}$ are preferably the same in order to obtain a single product.

$R^9$ to $R^{11}$ and $R^{14}$ to $R^{16}$ each represent a hydrogen atom or a hydrocarbyl group having 1 to 5 carbon atoms. In view of material availability, $R^9$ to $R^{11}$ and $R^{14}$ to $R^{16}$ each preferably represent a hydrogen atom.

Examples of a manufacturing method of the disulfide compound represented by the formula (2) are the following two methods. Specifically, the first manufacturing method is to oxidatively-couple a material of mercapto alkane carboxylic acid ester represented by the following formula (5) and/or by the following formula (6).

$$R^7OOC\text{—}CR^9R^{10}\text{—}CR^{11}(COOR^8)\text{—}SH \quad (5)$$

$$R^{12}OOC\text{—}CR^{14}R^{15}\text{—}CR^{16}(COOR^{13})\text{—}SH \quad (6)$$

In the formulae, $R^7$ to $R^{16}$ are the same as described above.

Examples of the product generated by the coupling reaction are three disulfide compounds as follows:

$$R^7OOC\text{—}CR^9R^{10}\text{—}CR^{11}(COOR^8)\text{—}S\text{—}S\text{— —}CR^{16}(COOR^{13})\text{—}CR^{14}R^{15}\text{—}COOR^{12};$$

$$R^7OOC\text{—}CR^9R^{10}\text{—}CR^{11}(COOR^8)\text{—}S\text{—}S\text{— —}CR^{11}(COOR^8)\text{—}CR^9R^{10}\text{—}COOR^7; \text{ and}$$

$$R^{12}OOC\text{—}CR^{14}R^{15}\text{—}CR^{16}(COOR^{13})\text{—}S\text{—}S\text{—}\text{—}CR^{16}(COOR^{13})\text{—}CR^{14}R^{15}\text{—}COOR^{12}.$$

An oxidant used in the coupling reaction may be the same as in the manufacturing of the disulfide compound represented by the formula (1).

On the other hand, the second manufacturing method of the disulfide compound is to oxidatively-couple a material of mercapto alkane carboxylic acid ester represented by the following formula (7) and/or by the following formula (8) and subsequently to esterify the material with monovalent alcohol formed of hydrocarbyl groups each having 1 to 30 carbon atoms (the hydrocarbyl groups each may contain an oxygen atom, a sulfur atom or a nitrogen atom).

$$HOOC\text{—}CR^9R^{10}\text{—}CR^{11}(COOH)\text{—}SH \quad (7)$$

$$HOOC\text{—}CR^{14}R^{15}\text{—}CR^{16}(COOH)\text{—}SH \quad (8)$$

In the formulae, $R^9$ to $R^{11}$ and $R^{14}$ to $R^{16}$ are the same as described above.

Examples of the product generated by the coupling reaction are three disulfide compounds as follows:

$$HOOC\text{—}CR^9R^{10}\text{—}CR^{11}(\text{—}COOH)\text{—}S\text{—}S\text{—}CR^{16}(COOH)\text{—}CR^{14}R^{15}\text{—}COOH;$$

$$HOOC\text{—}CR^9R^{10}\text{—}CR^{11}(\text{—}COOH)\text{—}S\text{—}S\text{—}CR^{11}(COOH)\text{—}CR^9R^{10}\text{—}COOH; \text{ and}$$

$$HOOC\text{—}CR^{14}R^{15}\text{—}CR^{16}(\text{—}COOH)\text{—}S\text{—}S\text{—}CR^{16}(COOH)\text{—}CR^{14}R^{15}\text{—}COOH.$$

An oxidant used in the coupling reaction may be the same as in the above.

Subsequently to the oxidative-coupling reaction, the material is esterified with alcohol represented by the following formula (9).

$$R^{17}\text{—}OH \quad (9)$$

In the formula, $R^{17}$ represents the same group as described in relation to $R^7$, $R^8$, $R^{12}$ and $R^{13}$.

The material may be esterified by an ordinary method according to which the material experiences dehydro-condensation under the presence of acid catalyst. By this method, three disulfide compounds as follows are generated:

$$R^{17}OOC\text{—}CR^9R^{10}\text{—}CR^{11}(COOR^{17})\text{—}S\text{—}S\text{—}CR^{16}(COOR^{17})\text{—}CR^{14}R^{15}\text{—}COOR^{17};$$

$$R^{17}OOC\text{—}CR^9R^{10}\text{—}CR^{11}(COOR^{17})\text{—}S\text{—}S\text{—}CR^{11}(COOR^{17})\text{—}CR^9R^{10}\text{—}COOR^{17}; \text{ and}$$

$$R^{17}OOC\text{—}CR^{14}R^{15}\text{—}CR^{16}(COOR^{17})\text{—}S\text{—}S\text{—}CR^{16}(COOR^{17})\text{—}CR^{14}R^{15}\text{—}COOR^{17}.$$

Examples of the disulfide compound represented by the formula (1) are bis(methoxycarbonylmethyl)disulfide, bis (ethoxycarbonylmethyl)disulfide, bis(n-propoxycarbonylmethyl)disulfide, bis(isopropoxylcarbonylmethyl)disulfide, bis(n-butoxycarbonylmethyl)disulfide, bis(n-octoxycarbonylmethyl)disulfide, bis(n-dodecyloxycarbonylmethyl)disulfide, bis(cyclopropoxycarbonylmethyl)disulfide, 1,1-bis(1-methoxycarbonylethyl)disulfide, 1,1-bis(1-methoxycarbonyl-n-propyl)disulfide, 1,1-bis(1-methoxycarbonyl-n-butyl)disulfide, 1,1-bis(1-methoxycarbonyl-n-hexyl)disulfide, 1,1-bis(1-methoxycarbonyl-n-octyl)disulfide, 1,1-bis(1-methoxycarbonyl-n-dodecyl)disulfide, 2,2-bis(2-methoxycarbonyl-n-propyl)disulfide, α,α-bis(α-methoxycarbonylbenzyl)disulfide, 1,1-bis(2-methoxycarbonylethyl)disulfide, 1,1-bis(2-ethoxycarbonylethyl)disulfide, 1,1-bis(2-n-propoxycarbonylethyl)disulfide, 1,1-bis(2-isopropoxycarbonylethyl)disulfide, 1,1-bis(2-cyclopropoxycarbonylethyl)disulfide, 1,1-bis(2-methoxycarbonyl-n-propyl)disulfide, 1,1-bis(2-methoxycarbonyl-n-butyl)disulfide, 1,1-bis(2-methoxycarbonyl-n-hexyl)disulfide, 1,1-bis(2-methoxycarbonyl-n-propyl)disulfide, 2,2-bis(3-methoxycarbonyl-n-pentyl)disulfide, 1,1-bis(2-methoxycarbonyl-1-phenylethyl)disulfide and the like.

Examples of the disulfide compound represented by the formula (2) are tetramethyl dithiomalate, tetraethyl dithiomalate, tetra-1-propyl dithiomalate, tetra-2-propyl dithiomalate, tetra-1-butyl dithiomalate, tetra-2-butyl dithiomalate, tetraisobutyl dithiomalate, tetra-1-hexyl dithiomalate, tetra-1-octyl dithiomalate, tetra-1-(2-ethyl)hexyl dithiomalate, tetra-1-(3,5,5-trimethyl)hexyl dithiomalate, tetra-1-decyl dithiomalate, tetra-1-dodecyl dithiomalate, tetra-1-hexadecyl dithiomalate, tetra-1-octadecyl dithiomalate, tetrabenzyl dithiomalate, tetra-α-(methyl)benzyl dithiomalate, tetra-α,α-dimethylbenzyl dithiomalate, tetra-1-(2-methoxy)ethyl dithiomalate, tetra-1-(2-ethoxy)ethyl dithiomalate, tetra-1-(2-butoxy)ethyl dithiomalate, tetra-1-(2-ethoxy)ethyl dithiomalate, tetra-1-(2-butoxy-butoxy)ethyl dithiomalate, tetra-1-(2-phenoxy)ethyl dithiomalate and the like.

In the present composition, one of the disulfide compounds may be singularly used as the component (A) or a combination of two or more thereof may be used as the component (A).

In view of a balance between wear resistance-providing effects, influence of emission gas over a purification catalyst and a cost, the component (A) is preferably contained in the composition with a content of 0.01 to 0.5 mass % in terms of sulfur of the total amount of the composition, more preferably 0.01 to 0.3 mass %.

Components (B) and (C)

In addition to the disulfide compound of the component (A), the present composition contains: a no-boron-containing ashless dispersant having in the side chain an alkyl group having a number average molecular weight of 500 to 3,000 or an alkenyl group having a number average molecular weight of 500 to 3,000 (component (B)); and a boron-containing ashless dispersant having in the side chain an alkyl group having a number average molecular weight of 500 to 4,000 or an alkenyl group having a number average molecular weight of 500 to 4,000 (component (C)).

As the no-boron-containing ashless dispersant having in the side chain an alkyl group having a number average molecular weight of 500 to 3,000 or an alkenyl group having a number average molecular weight of 500 to 3,000 (i.e., the component (B)), a variety of dispersants can be used, some examples of which are [1] alkyl or alkenyl-succinimide, [2] alkyl or alkenyl aliphatic amide, and [3] alkyl or alkenyl benzyl amine.

Representative examples of the alkyl or alkenyl-succinimide of the above [1] are succinimide having a polybutenyl group and succinimide having a polyisobutenyl group. The polybutenyl group means polymerized mixture of 1-butene and isobutene, polymerized highly-pure isobutene or a hydrogenerated polyisobutenyl group. The succinimide may be so-called mono-type alkenylsuccinimide or alkylsuccinimide, or so-called bis-type alkenylsuccinimide or alkylsuccinimide.

Polybutenyl succinimide may be manufactured by a conventional method. In order to manufacture polybutenyl succinimide, for instance, polybutene or chlorinated polybutene having a number average molecular weight of approximately 500 to 3,000 is reacted with maleic anhydride at approximately 100 to 200 degrees C. to form polybutenyl succinic acid, and the obtained polybutenyl succinic acid is reacted with polyamine.

Examples of polyamine are diethylene amine, triethylene tetramine, tetraethylene pentamine, pentaethylene hexamine and the like.

The alkyl or alkenyl-succinimide may be an alkylphenol derivative or a sulfurized alkylphenol derivative in which the alkyl or alkenyl-succinimide is condensed with an aromatic compound such as alkylphenol or sulfurized alkylphenol by Mannich condensation. The alkyl group of the alkylphenol typically has 3 to 30 carbon atoms.

The aliphatic amide of the above [2] is formed of aliphatic acid and polyamine. A preferable example of the aliphatic acid is a linear or branched saturated or unsaturated carboxylic acid having 8 to 24 carbon atoms. Examples of the polyamine are the same as in the above [1].

Examples of the alkenyl or alkyl group of the alkyl or alkenyl benzyl amine of the above [3] are the same as in the above [1].

The no-boron-containing ashless dispersant as the component (B), which has in the side chain an alkyl or alkenyl group having a number average molecular weight of 500 to 3,000, unfavorably exhibits deteriorated dispersibility into the base oil when the number average molecular weight of the side chain is less than 500. On the other hand, when the number average molecular weight of the side chain is more than 3,000, the dispersant exhibits deteriorated handleability when the lubricating oil composition is prepared, and the prepared composition may exhibit excessively high viscosity, so that fuel consumption may not be reduced.

Nitrogen content derived from the component (B) is preferably 50 to 4,000 ppm by mass, more preferably 50 to 3,000 ppm by mass. When the nitrogen content derived from the component (B) is 50 ppm by mass or more, the prepared composition exhibits sufficient dispersibility. In addition, when the nitrogen content derived from the component (B) is 4,000 ppm by mass or less, oxidation stability and viscosity characteristics of the composition can be maintained, thereby preferably reducing the fuel consumption and the manufacturing cost.

The boron-containing ashless dispersant as the component (C) may be a product formed by treating the alkyl or alkenyl-succinimide of the above [1] with a boron compound, a product formed by treating the aliphatic amide of the above [2] with a boron compound, or a product formed by treating the alkyl or alkenyl benzyl amine with a boron compound.

The boron-containing succinimide may be manufactured by a conventional method. Specifically, in order to manufacture the boron-containing succinimide, an organic solvent such as alcohols, hexane or xylene is added with the polyamine, polybutenyl succinic acid (anhydride) and a boron compound such as boracic acid, and is subsequently heated under suitable conditions.

Examples of the boron compound used in treating the above [1] to [3] are boracic acid, boric anhydride, boron halogenide, borate ester, amide borate, boric oxide and the like. Among the above, boracic acid is particularly preferable. Among the above boron-containing ashless dispersants, boron-containing succinimide formed by treating alkenyl or alkyl-succinimide with a boron compound is particularly preferable.

The boron-containing ashless dispersant as the component (C), which has in the side chain an alkyl or alkenyl group having a number average molecular weight of 500 to 4,000, unfavorably exhibits deteriorated dispersibility into the base oil when the number average molecular weight of the side chain is less than 500. On the other hand, when the number average molecular weight of the side chain is more than 4,000, the dispersant exhibits excessively high viscosity, so that the lubricating oil composition cannot favorably reduce fuel consumption. Additionally, the dispersant exhibits deteriorated handleability when the lubricating oil composition is prepared.

Boron content derived from the component (C) is preferably 50 to 3,000 ppm by mass, more preferably 50 to 2,500 ppm by mass. When the boron content derived from the component (C) is 50 ppm by mass or more, the prepared composition exhibits sufficient heat resistance. In addition, when the boron content derived from the component (C) is 3,000 ppm by mass or less, hydrolysis of boron portions can be prevented, thereby preferably further reducing the manufacturing cost.

Since the lubricating base oil is added with (A) the specific disulfide compound, (B) the specific no-boron-containing ashless dispersant and (C) the specific boron-containing ashless dispersant as essential components, the present composition can exhibit excellent wear resistance and long-drain capabilities. The lubricating oil composition for an internal combustion engine according to the present invention can be particularly favorably applied to lubricating oil for diesel engines.

The present composition is preferably further added with an antioxidant. Preferable examples of the antioxidant are a phenol-base antioxidant and an amine-base antioxidant.

The phenol-base antioxidant may be any suitable one of known phenol-base antioxidants conventionally used as antioxidants of lubricating oil. Preferable examples of the phenol-base antioxidant are 2,6-di-tert-butyl-4-methylphenol, 2,6-di-tert-butyl-4-ethylphenol, 2,4,6-tri-tert-butylphenol, 2,6-di-tert-butyl-4-hydroxymethylphenol, 2,6-di-tert-butylphenol, 2,4-dimethyl-6-tert-butylphenol, 2,6-di-tert-butyl-4-(N,N-dimethylaminomethyl)phenol, 2,6-di-tert-amyl-4-methylphenol, 4,4'-methylenebis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,4-dimethyl-6-tert-butylphenol, 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl) sulfide, bis(3,5-di-tert-butyl-4-hydroxybenzyl)sulfide, 2,2'-thio-diethylenebis[3-(3,5-di-tert-butyl-4-hydroxyphenyl) propionate], tridecyl-3-(3,5-di-tert-butyl-4-hydroxyphenyl) propionate, pentaerythrityl-tetraxis[3-(3,5-di-tert-butyl-4-hydroxyphenyl)propionate], octyl-3-(3,5-di-tert-butyl-4-hydroxyphenyl)propionate, octadecyl-3-(3,5-di-tert-butyl-4-hydroxyphenyl)propionate, octyl-3-(3-methyl-5-tert-butyl-4-hydroxyphenyl)propionate and the like.

On the other hand, the amine-base antioxidant may be any suitable one of known amine-base antioxidants conventionally used as antioxidants of lubricating oil. The amine-base antioxidant may be a diphenylamine-base antioxidant, diphenylamine of which is exemplified by diphenylamine and alkylated diphenylamine having an alkyl group having 3 to 20 carbon atoms such as monooctyl diphenylamine, monononyl diphenylamine, 4,4'-dibutyl diphenylamine, 4,4'-dihexyl diphenylamine, 4,4'-dioctyl diphenylamine, 4,4'-dinonyl diphenylamine, tetrabutyl diphenylamine, tetrahexyl diphenylamine, tetraoctyl diphenylamine or tetranonyl dipheylamine, or a naphthylamine-base antioxidant, naphthylamine of which is exemplified by α-naphthylamine, phenyl-α-naphthylamine and alkyl-substituted phenyl-α-naphthylamine having 3 to 20 carbon atoms such as butylphenyl-α-naphthylamine, hexylphenyl-α-naphthylamine, octylphenyl-α-naphthylamine or nonylphenyl-α-naphthylamine. Among the above, diphenylamine-base antioxidant is more preferable than naphthylamine-base antioxidant in view of effects. Particularly, alkylated diphenylamine having an alkyl group having 3 to 20 carbon atoms is preferable. Further, 4,4'-di(C3 to C20 alkyl)diphenyl amine is more preferable.

The present composition may be added with single one of the above phenol-base antioxidants or added with a combination of two or more thereof. The present composition may be added with single one of the above amine-base antioxidants or added with a combination of two or more thereof. Further, a combination of at least one of the above phenol-base antioxidants and at least one of the above amine-base antioxidants is more preferable.

In view of a balance between effects and cost and the like, the antioxidant is preferably contained in the composition with content of 0.05 to 7 mass % of the total amount of the composition, more preferably with a content of 0.05 to 5 mass %.

The present composition may be suitably added with other various additives such as a viscosity index improver, a pour point depressant, a rust inhibitor, a metal-corrosion inhibitor, an antifoaming agent and a surfactant.

Examples of the viscosity index improver are polymethacrylate, dispersed polymethacrylate, an olefin-based copolymer (such as an ethylene-propylene copolymer), a dispersed olefin-based copolymer, a styrene-based copolymer (such as a styrene-diene copolymer and a styrene-isoprene copolymer) and the like. In view of blending effects, a content of the viscosity index improver is approximately 0.5 to 15 mass % of the total amount of the composition, preferably 1 to 10 mass %.

Examples of the pour point depressant are a copolymer of ethylene and vinyl acetate, a condensation product of paraffin chloride with naphthalene, a condensation product of paraffin chloride with phenol, polymethacrylate, polyalkylstyrene and the like. Among the above, polymethacrylate having a mass-average molecular weight of approximately 5,000 to 50,000 is preferable. The pour point depressant is contained with a content of 0.1 to 5 mass % of the total amount of the composition.

Examples of the rust inhibitor are petroleum sulfonate, alkylbenzene sulfonate, dinonylnaphthalene sulfonate, alkenyl succinic ester, multivalent alcohol ester and the like. In view of blending effects, a content of the rust inhibitor is approximately 0.01 to 1 mass % of the total amount of the composition, preferably 0.05 to 0.5 mass %.

Examples of the metal deactivator are benzotriazole-based compounds, tolyltriazole-based compounds, thiadiazole-based compounds, imidazole-based compounds and the like. In view of blending effects, a content of the metal deactivator is approximately 0.01 to 1 mass % of the total amount of the composition, preferably 0.01 to 0.5 mass %.

Examples of the antifoaming agent are silicone, fluorosilicone, fluoroalkylether and the like. In view of a balance between antifoaming effects and cost and the like, a content of the antifoaming agent is preferably approximately 0.005 to 0.1 mass % of the total amount of the composition.

Examples of the surfactant are nonionic surfactants based on polyalkylene glycol such as polyoxyethylenealkylether, polyoxyethylenealkylphenylether and polyoxyethylenealkylnaphthylether.

The present composition preferably contains phosphorus by a content of not more than 0.1 mass %. When the phosphorus content is 0.1 mass % or less, deterioration of performance of the catalyst for purifying exhaust gas can be prevented. The phosphorus content is more preferably 0.08 mass % or less, more preferably 0.05 mass % or less. The phosphorus content can be measured based on, for instance, Japan Petroleum Institute (hereinafter abbreviated as JPI)-5S-38-92.

The present composition preferably contains sulfated ash by a content of not more than 1 mass %. When the sulfate ash content is 1 mass % or less, deterioration of performance of the catalyst for purifying exhaust gas can be prevented as described above. In addition, in a case of a diesel engine, clogging of the filter of the DPF due to the ash content accumulated thereon can be reduced, thereby contributing to a long life of the DPF. The sulfated ash content is more preferably 0.8 mass % or less, more preferably 0.5 mass % or less. The sulfated ash content means ash content obtained by adding sulfuric acid to carbonized residue caused by combustion of samples to heat the residue so that the residue has a constant mass. The sulfate ash is used to know a rough amount of metal-based additives contained in the lubricating oil composition. The sulfated ash content can be measured based on, for instance, JIS K2272.

EXAMPLES

Next, the present invention will be further described in detail by reference to Examples, which by no means limit the present invention.

Examples 1, 2 and Comparatives 1 to 4

Lubricating oil compositions containing components shown in Table 1 was prepared, and long-drain capabilities and wear resistance of the compositions each were evaluated. Additionally, heat resistance of the compositions each was checked. Table 1 also shows a reference example in which a lubricating oil composition was added with a metal-base detergent and ZnDTP so that the lubricating oil composition met requirements of DL-1 Standard of Japan Automobile Standard Organization (hereinafter abbreviated as JASO).

The components used for preparing the lubricating oil compositions are as follows:

(1) Lubricating Base Oil A: poly-α-olefin, kinetic viscosity at 40 degrees C. of 63 $mm^2/s$, kinetic viscosity at 100 degrees C. of 9.8 $mm^2/s$, viscosity index of 139;

(2) Lubricating Base Oil B: hydrorefined mineral oil (100N), kinetic viscosity at 40 degrees C. of 21.0 $mm^2/s$, kinetic viscosity at 100 degrees C. of 4.5 $mm^2/s$, viscosity index of 127;

(3) Lubricating Base Oil C: hydrorefined mineral oil (SOON), kinetic viscosity at 40 degrees C. of 90.5 $mm^2/s$, kinetic viscosity at 100 degrees C. of 10.89 $mm^2/s$, viscosity index of 107;

(4) Disulfide A: bis(n-octoxycarbonylmethyl)disulfide, sulfur content in the compound of 15.8 mass %;

(5) Disulfide B: bis(n-tetraxycarbonylmethyl)disulfide, sulfur content in the compound of 20.78 mass %;

(6) Ashless Dispersant A: no-boron-containing alkenyl succinimide having a polybutenyl group having a number average molecular weight of 950, nitrogen content in the compound of 2.1 mass %;

(7) Ashless Dispersant B: boron-modified alkenyl succinimide having a polybutenyl group having a number average molecular weight of 950, nitrogen content in the compound of 1.8 mass %, boron content in the compound of 2.1 mass %;

(8) Metal-Based Detergent A: overbased calcium salicylate, base number of 170 mg KOH/g (perchloric acid method), calcium content in the compound of 6.1 mass %;

(9) ZnDTP: a mixture in which secondary alkyl-type zinc dialkyldithiophosphate (zinc content of 7.9 mass %, phosphorus content of 7.2 mass %, sulfur content of 15.0 mass %) and primary alkyl-type zinc dialkyldithiophosphate (zinc content of 8.9 mass %, phosphorus content of 7.4 mass %, sulfur content of 15.0 mass %) were mixed at a phosphorus mass ratio of 1:4;

(10) Antioxidant: a mixture in which monobutylphenyl-monooctylphenyl-amine, 4,4'methylenebis(2,6-di-t-butylphenol), and octadecyl 3(3,5-di-t-butyl-4-hydroxyphenyl)propionate were mixed at a mass ratio of 1:2:2 respectively; and

(11) Other Additives: metal deactivator (alkylbenzotriazol) and a silicone-based antifoaming agent.

Measurement of long drain capabilities, wear resistance and heat resistance of the lubricating oil compositions each were evaluated in the following manner. Results are shown in Table 1.

(Long-Drain Capabilities)

Long drain capabilities of each lubricating oil composition were evaluated by comparing the initial base number of the composition with the base number of the composition after an oxidation stability test for lubricating oil composition for an internal combustion engine (Indiana Stirring Oxidation Test, hereinafter abbreviated as ISOT).

Base number: measured based on JIS K 2501 (hydrochloric acid method)

ISOT: measured based on JIS K 2514 (165.5 degrees C., for 96 hours) (Wear Resistance)

Wear Resistance of each composition was evaluated by conducting a wear test of valve operation system (camnose wear test, based on JASO M328-5) using KA24 model manufactured by Nissan Motor Co., Ltd.

(Heat Resistance)

Heat resistance of each composition was evaluated using a color scale of 0 to 10 by conducting a hot tube test at 280 degrees C. (based on JPI-5S-55-99).

TABLE 1

| | | Example 1 | Example 2 | Comparative 1 | Comparative 2 | Comparative 3 | Comparative 4 | Reference Example |
|---|---|---|---|---|---|---|---|---|
| Composition[1)] | Lubricating base oil A (PAO) | residue | residue | residue | residue | — | — | — |
| | Lubricating base oil B (100N mineral oil) | — | — | — | — | residue | residue | residue |
| | Lubricating base oil C (500N mineral oil) | — | — | — | — | 5.00 | 5.00 | 5.00 |
| | Disulfide A (ppm by mass in terms of S) | 1.200 | — | — | — | — | — | — |
| | Disulfide B (ppm by mass in terms of S) | — | 1.200 | — | — | — | — | — |
| | Ashless dispersant A (ppm by mass in terms of N) | 400 | 400 | 1.750 | — | 250 | 250 | 250 |
| | Ashless dispersant B (ppm by mass in terms of B) | 1.700 | 1.700 | — | 2.150 | 400 | 400 | 400 |
| | Metal-base detergent A (ppm by mass in terms of Ca) | — | — | — | — | — | 1.000 | 1.000 |
| | ZnDTP (ppm by mass in terms of P) | — | — | — | — | — | — | 750 |
| | Antioxidant | 2.00 | 2.00 | 2.00 | 2.00 | 2.00 | 2.00 | 2.00 |
| | Others | 0.15 | 0.15 | 0.15 | 0.15 | 0.15 | 0.15 | 0.15 |
| | Total | 100 | 100 | 100 | 100 | 100 | 100 | 100 |
| Base Number (mgKOH/g) | Initial base number | 3.1 | 3.1 | 3.1 | 3.1 | 0.3 | 4.1 | 4.1 |
| | Base number after 96 hours of ISOT at 165.5° C. | 0.42 | 0.40 | 0.10 | 0.13 | 0.00 | 1.50 | 0.36 |
| Camnose Wear Test (μm) | Based on JASO M328-95 | 2.8 | 3.5 | — | — | — | 51.9 | 5.1 |
| Hot Tube Test (merit grade) | Based on JPI-5S-55-99 | 10.0 | 10.0 | 1.0 | 10.0 | 10.0 | 10.0 | 8.5 |

[1)]Components represented by no unit are represented by mass %.

[Evaluation Results]

As is understood from the evaluation results of Table 1, Examples 1 and 2 in which the lubricating oil composition according to the present invention was used exhibited excellent long-drain capabilities and wear resistance although neither Example 1 nor 2 contained metal detergent or ZnDTP. In addition, Examples 1 and 2 exhibited practically applicable heat resistance.

In contrast, Comparatives 1 and 2 each correspond to a composition formed by removing the metal-base detergent and ZnDTP from the composition of the reference example. Comparatives 1 and 2 each were added with only either one of the no-boron-containing dispersant and the boron-modified dispersant as the ashless dispersant. Although the base number of each Comparative was increased, Comparative 1 exhibited insufficient heat resistance while Comparative 2 exhibited deteriorated long-drain capabilities.

Comparative 3, which also corresponds to the composition formed by removing the metal-base detergent and ZnDTP from the composition of the reference example, was added with both the no-boron-containing dispersant and the boron-modified dispersant as the ashless dispersant. However, Comparative 3 exhibited insufficient long-drain capabilities.

Although Comparative 4, which corresponds to a composition formed by removing ZnDTP (antiwear agent) from the composition of reference example, exhibited sufficient long-drain capabilities, the wear resistance of Comparative 4 was significantly deteriorated.

The invention claimed is:

1. A lubricating oil composition, comprising:

(L) a lubricating base oil;

(A) component (A), which is at least one of (a1) a disulfide compound of formula (1)

$$R^1OOC\text{-}A^1\text{-}S\text{—}S\text{-}A^2\text{-}COOR^2 \quad (1),\text{ and}$$

(a2) a disulfide compound of formula (2)

$$R^7OOC\text{—}CR^9R^{10}\text{—}CR^{11}(COOR^8)\text{—}S\text{—}S\text{—}CR^{16}(COOR^{13})\text{—}CR^{14}R^{15}\text{—}COOR^{12} \quad (2)$$

wherein $A^1$ and $A^2$ are independently a group represented by $CR^3R^4$ or a group presented by $CR^3R^4$—$CR^5R^6$, in which $R^3$ to $R^6$ are independently a hydrogen atom or a hydrocarbyl group comprising 1 to 20 carbon atoms, $R^1$, $R^2$, $R^7$, $R^8$, $R^{12}$, and $R^{13}$ are independently a hydrocarbyl group comprising 1 to 30 carbon atoms, wherein the hydrocarbyl group optionally comprises an oxygen atom, a sulfur atom, or a nitrogen atom, and $R^9$ to $R^{11}$ and $R^{14}$ to $R^{16}$ are independently a hydrogen atom or a hydrocarbyl group comprising 1 to 5 carbon atoms;

(B) component (B), which is a boron-free ashless dispersant comprising, in its side chain, (b1) an alkyl group having a number average molecular weight of 950 to 3000; or (b2) an alkenyl group having a number average molecular weight of 950 to 3000; and (C) component (C), which is a boron-containing ashless dispersant comprising, in its side chain, (c1) an alkyl group having a number average molecular weight of 950 to 4000; or (c2) an alkenyl group having a number average molecular weight of 950 to 4000, wherein the lubricating base oil (L) has a % CA of 3 or less, wherein the lubricating base oil (L) has a sulfur content of 50 mass ppm or less, wherein a content of the component (A) is 0.01 to 0.5 mass % of a total amount of the composition based on sulfur, wherein the composition comprises substantially no metal base detergent, and wherein the composition has a phosphorus content of 0.1 mass % or less, based on the total amount of the composition wherein a nitrogen content in the component (B) is 50 to 4000 ppm by mass, based on the total amount of the lubricating oil composition, and wherein a boron content in the component (C) is 50 to 3000 ppm by mass, based on the total amount of the lubricating oil composition.

2. The composition of claim 1, wherein the component (B) is at least one of an alkyl succinimide, an alkenyl succinimide, an aliphatic amide, an alkyl benzyl amine, and an alkenyl benzyl amine.

3. The composition of claim 1, wherein the component (C) is a product formed by boron-modifying at least one of alkyl succinimide, alkenyl succinimide, aliphatic amide, alkyl benzyl amine, and alkenyl benzyl amine.

4. The composition of claim 2, wherein the component (B) comprises the alkyl succinimide.

5. The composition of claim 2, wherein the component (B) comprises the alkenyl succinimide.

6. The composition of claim 2, wherein the component (B) comprises the aliphatic amide.

7. The composition of claim 2, wherein the component (B) comprises the alkyl benzyl amine.

8. The composition of claim 2, wherein the component (B) comprises the alkenyl benzyl amine.

9. The composition of claim 1, wherein the alkenyl group (b2) is present and has a number average molecular weight of 950 to 3000.

10. The composition of claim 3, wherein the component (C) comprises a boron-modified alkyl succinimide.

11. The composition of claim 3, wherein the component (C) comprises a boron-modified alkenyl succinimide.

12. The composition of claim 3, wherein the component (C) comprises a boron-modified aliphatic amide.

13. The composition of claim 3, wherein the component (C) comprises a boron-modified alkyl benzyl amine.

14. The composition of claim 3, wherein the component (C) comprises a boron-modified alkenyl benzyl amine.

15. The composition of claim 1, wherein the component (A) comprises the disulfide compound (a1).

16. The composition of claim 1, wherein the component (A) comprises the disulfide compound (a2).

17. The composition of claim 1, wherein the component (A) comprises at least one of bis(methoxycarbonylmethyl) disulfide, bis(ethoxycarbonylmethyl)disulfide, bis(n-propoxycarbonylmethyl)disulfide, bis(isopropoxylcarbonylmethyl)disulfide, bis(n-butoxycarbonylmethyl)disulfide, bis(n-octoxycarbonylmethyl)disulfide, bis(n-dodecyloxycarbonylmethyl)disulfide, bis(cyclopropoxycarbonylmethyl)disulfide, 1,1-bis(1-methoxycarbonylethyl)disulfide, 1,1-bis(1-methoxycarbonyl-n-propyl)disulfide, 1,1-bis(1-methoxycarbonyl-n-butyl)disulfide, 1,1-bis(1-methoxycarbonyl-n-hexyl)disulfide, 1,1-bis(1-methoxycarbonyl-n-octyl)disulfide, 1,1-bis(1-methoxycarbonyl-n-dodecyl)disulfide, 2,2-bis(2-methoxycarbonyl-n-propyl) disulfide, α,α-bis(α-methoxycarbonylbenzyl)disulfide, 1,1-bis(2-methoxycarbonylethyl)disulfide, 1,1-bis(2-ethoxycarbonylethyl)disulfide, 1,1-bis(2-n-propoxycarbonylethyl)disulfide, 1,1-bis(2-isopropoxycarbonylethyl)disulfide, 1,1-bis(2-cyclopropoxycarbonylethyl)disulfide, 1,1-bis(2-methoxycarbonyl-n-propyl)disulfide, 1,1-bis(2-methoxycarbonyl-n-butyl)disulfide, 1,1-bis(2-methoxycarbonyl-n-hexyl)disulfide, 1,1-bis(2-methoxycarbonyl-n-propyl)disulfide, 2,2-bis(3-methoxycarbonyl-n-pentyl)disulfide, and 1,1-bis(2-methoxycarbonyl-1-phenylethyl)disulfide.

18. The composition of claim 1, wherein the component (A) comprises at least one of tetramethyl dithiomalate, tetraethyl dithiomalate, tetra-1-propyl dithiomalate, tetra-2-propyl dithiomalate, tetra-1-butyl dithiomalate, tetra-2-butyl dithiomalate, tetraisobutyl dithiomalate, tetra-1-hexyl dithiomalate, tetra-1-octyl dithiomalate, tetra-1-(2-ethyl)hexyl dithiomalate, tetra-1-(3,5,5-trimethyl)hexyl dithiomalate, tetra-1-decyl dithiomalate, tetra-1-dodecyl dithiomalate, tetra-1-hexadecyl dithiomalate, tetra-1-octadecyl dithiomalate, tetrabenzyl dithiomalate, tetra-α-(methyl)benzyl dithiomalate, tetra-α,α-dimethylbenzyl dithiomalate, tetra-1-(2-methoxy)ethyl dithiomalate, tetra-1-(2-ethoxy)ethyl dithiomalate, tetra-1-(2-butoxy)ethyl dithiomalate, tetra-1-(2-ethoxy)ethyl dithiomalate, tetra-1-(2-butoxy-butoxy) ethyl dithiomalate, and tetra-1-(2-phenoxy)ethyl dithiomalate.

19. The composition according to claim 1, wherein the lubricating base oil (L) is a synthetic oil.

* * * * *